United States Patent [19]

Risi et al.

[11] Patent Number: 5,064,313

[45] Date of Patent: Nov. 12, 1991

[54] EMBANKMENT REINFORCING STRUCTURES

[75] Inventors: Angelo Risi; Antonio Risi, both of Richmond Hill, Canada

[73] Assignee: Rothbury Investments Limited, Gormley, Canada

[21] Appl. No.: 585,874

[22] Filed: Sep. 20, 1990

[30] Foreign Application Priority Data

May 25, 1990 [CA] Canada ..... 2017518

[51] Int. Cl.[5] ..... E02D 29/02

[52] U.S. Cl. ..... 405/284; 405/258; 405/286

[58] Field of Search ..... 405/258, 262, 272, 284, 405/285, 286, 287

[56] References Cited

U.S. PATENT DOCUMENTS

| | | | |
|---|---|---|---|
| 250,635 | 12/1881 | McLean . | |
| 991,722 | 5/1911 | Hourd . | |
| 1,474,195 | 11/1923 | Langworthy . | |
| 1,762,343 | 12/1925 | Munster . | |
| 1,812,364 | 6/1931 | Oursler . | |
| 2,315,351 | 3/1943 | Schaefer | 61/35 |
| 2,858,582 | 11/1958 | Toulmin, Jr. | 20/4 |
| 3,195,312 | 7/1965 | Rumsey, Jr. | 61/39 |
| 3,421,326 | 1/1969 | Vidal | 61/39 |
| 3,561,219 | 2/1971 | Nishizawa et al. | 61/38 |
| 3,587,964 | 6/1971 | Cork | 238/2 |
| 3,613,382 | 10/1971 | Dickinson | 61/49 |
| 3,686,873 | 8/1972 | Vidal | 405/262 |
| 3,922,864 | 12/1975 | Hilfiker | 61/35 |
| 3,925,994 | 12/1975 | Broms et al. | 61/39 |
| 4,051,570 | 10/1977 | Hilfiker | 14/26 |
| 4,068,482 | 1/1978 | Hilfiker | 61/47 |
| 4,116,010 | 9/1978 | Vidal | 405/262 |
| 4,117,686 | 10/1978 | Hilfiker | 405/284 |
| 4,229,922 | 10/1980 | Clark, Jr. | 52/586 |
| 4,273,476 | 6/1981 | Kotulla et al. | 405/258 |
| 4,324,508 | 4/1982 | Hilfiker et al. | 405/284 |
| 4,329,089 | 5/1982 | Hilfiker et al. | 405/262 |
| 4,341,491 | 7/1982 | Neumann | 405/258 |
| 4,343,571 | 8/1982 | Price | 405/284 |
| 4,343,572 | 8/1982 | Hilfiker | 405/284 |
| 4,391,557 | 7/1983 | Hilfiker et al. | 405/287 |
| 4,449,857 | 5/1984 | Davis | 405/286 |
| 4,470,720 | 9/1984 | Lennard | 405/161 |
| 4,470,728 | 9/1984 | Broadbent | 405/284 |
| 4,494,892 | 1/1985 | Wojciechowski | 404/6 |
| 4,616,959 | 10/1986 | Hilfiker | 405/286 |
| 4,661,023 | 4/1987 | Hilfiker | 405/262 |
| 4,728,227 | 3/1988 | Wilson et al. | 405/284 |
| 4,815,897 | 3/1989 | Risi et al. | 405/284 |
| 4,824,293 | 4/1989 | Brown et al. | 405/284 |
| 4,835,931 | 6/1989 | Eckerud | 52/586 |
| 4,914,876 | 4/1990 | Forsberg | 405/286 X |

FOREIGN PATENT DOCUMENTS

| | | | |
|---|---|---|---|
| 890150 | 1/1972 | Canada | 61/51 |
| 1003231 | 1/1977 | Canada | 61/48 |
| 1117777 | 2/1982 | Canada | 61/51 |
| 2303121 | 1/1976 | France . | |
| 57-74432 | 5/1982 | Japan . | |
| 281265 | 12/1970 | U.S.S.R. . | |
| 1485004 | 9/1977 | United Kingdom . | |

OTHER PUBLICATIONS

Minislope ® System, by Permacon Montco, 2nd page, published at least as early as Apr. 1989.

*Primary Examiner*—David H. Corbin
*Attorney, Agent, or Firm*—Weldon F. Green

[57] ABSTRACT

This invention relates to improvements in the control and stabilization of earthen or soil embankments comprising a gravity facing wall tied to and anchored by a grid or mesh extending into the embankment. The gravity facing wall is comprised of facing wall units or blocks stacked in overlapping horizontal courses. In particular an improved facing wall unit or block is provided featuring a projection formation extending longitudinally of the block in the upper surface and, in the lower surface, an offset recess of matching extent and configuration to the projection formation. The projection formation further includes grid or mesh engaging projections which penetrate the mesh or grid when registered thereover. A further recess or depression is also included in the upper surface of the facing wall unit or block and is of such an extent and configuration so as to confine therewithin the grid or mesh engaging projections and the grid or mesh when registered thereover.

24 Claims, 6 Drawing Sheets

EMBANKMENT REINFORCING STRUCTURES

FIELD OF THE INVENTION

This invention relates to improvements in the control and stabilization of earthen or soil embankments and more particularly to an improved stable retaining wall system wherein the facing wall thereof is adapted to be anchored by embankment penetrating components.

More particularly this invention relates to improvements in a retaining wall system wherein the facing wall is comprised of stacked interlocking overlapping concrete facing wall units or blocks and wherein the embankment penetrating anchoring components comprise tensioned sheets or strips of material that have a soil reinforcing mesh or grid-like character to be tied or connected to the facing wall of the retaining wall system in a manner so as to extend rearwardly therefrom in a generally horizontally layered arrangement within the compacted mass of the embankment backfill.

Still more particularly this invention relates to improvements in a stackable interlocking concrete block for incorporation into the facing wall of the aforementioned retaining wall system for better facilitating and preserving the tie or connection to be established between such facing wall and the respective sheets or strips of soil reinforcing mesh or grid.

BACKGROUND OF THE INVENTION

Stable mortarless gravity facing walls derived from stackable interlocking overlapping concrete blocks or stretchers adapted to be anchored to the compacted mass of an embankment backfill by embankment penetrating anchoring components derived from interlocking concrete blocks called either tiebacks or headers are well known.

The control and stability of embankments achieved by retaining wall systems using interlocking concrete stretchers and tiebacks or headers are exemplified by Canadian patent no. 941,626, U.S. Pat. No. 4,490,075, and U.S. Pat. No. 4,815,897.

The footings for the installations of the aforementioned patents are prepared first through excavation of the soil to a depth of the order of 9 inches (230 mm) upon which 2 to 3 inches (50–75 mm) of granular base is compacted, whereupon the lowermost or first course of the concrete blocks or stretchers are laid out either at a selected angle in relation to the horizontal, as shown by Canadian patent no. 941,626, or levelled in all directions, as in the case of the aforementioned U.S. patents.

The footings may also include concrete pads laid lowermost upon or within the compacted granular base where deemed appropriate.

According to Canadian patent no. 941,626 where the height of the embankment to be contained, or the conditions of the soil of the embankment, or climatic conditions require that the gravity facing wall be strengthened, wider, heavier and thicker concrete blocks or stretchers can be provided in the lower courses of the facing wall. Further, by introducing tieback or header blocks at selected intervals in the facing wall, the increased weight or mass of such facing wall and increased penetration of the embankment by such tieback or header blocks impart greater resistance to the shifting or overturning forces generated by the soil pressures of the embankment and therefore provide greater overall stability and longevity to such an installation.

The modular stacked interlocking concrete blocks or stretchers of the gravity facing walls of the aforementioned U.S. Pat. Nos. 4,490,075 and 4,815,897, may not require any embankment penetrating anchoring components where the facing walls confining the embankment have sufficient weight or mass overall to resist dislodgement or overturning by the driving forces within the embankment; such driving forces result from stresses due to the weight of the soil, surcharge load, water pressures or the like.

Where soil conditions of the embankment or climatic conditions are more critical or the height of the embankment contained requires the gravity facing wall to be strengthened, reinforcement to strengthen and stabilize the gravity facing wall derived from modular stacked interlocking concrete blocks or stretchers arranged in horizontal courses of the aforementioned U.S. patents can be accomplished by introducing a series of embankment penetrating modular concrete blocks in the form of tiebacks or headers, which can be appropriately introduced into and interlock with the facing wall blocks or stretchers at selected intervals within the horizontal courses.

As well, such an installation may also include modular stacked interlocked overlapped rear blocks or stretchers which, together with the facing wall blocks or stretchers and tiebacks or headers, define an embankment penetrating cribbing structure to thereby more securely anchor the facing wall against dislodgement or overturning.

Such retaining wall systems utilizing concrete blocks for the facing wall as well as for embankment penetrating reinforcement have certain limitations in that different sizes and shapes of blocks must be manufactured and therefore different moulds provided which increase the costs of production.

Moreover with such systems, because of their overall weight or mass, transportation and labour costs for delivering and installing the units are quite substantial.

It is well known that unstable zones within the slopes of earthen or soil embankments can be strengthened, and thereby better controlled or stabilized, by appropriately anchored and tensioned horizontally layered sheets or strips of mesh or grid-like material, either metallic or synthetic, arranged within the embankment.

When so layered, anchored, and maintained in tension under compression through compacting of the earthen or soil fill of the embankment, the surfaces of the mesh or grid-like material frictionally engage with the soil or earthen particles and so reinforce or strengthen the mass in those regions whereby the likelihood of slope failure is substantially reduced.

Since by introducing within the embankment tensioned layered sheets or strips of mesh or grid-like material greater stability is imparted to the embankment, any facing wall to be installed to contain same would have less soil pressure exerted from behind, and, accordingly, thinner or lighter blocks could be utilized in the facing wall of such an installation.

In addition, by selectively tying or securing the layered sheets or strips to the facing wall to serve as an anchor for such wall, the tensioned sheets or strips would impart even greater stability to the installation.

Whereas retaining wall systems that utilize facing panels or blocks tied to horizontally layered sheets or strips of mesh or grid-like material and tensioned within compacted backfill are known and represented by the following U.S. patents, namely U.S. Pat. Nos. 3,925,994, 4,324,508, 4,661,023, 4,728,227, and 4,824,293, several of them are quite complex, utilizing various shapes of interlocking facing blocks or panels with fittings or accessories for establishing the tie or interconnection between such facing blocks or panels and the sheets or strips.

U.S. Pat. No. 3,925,994 discloses a relatively simple reinforcement wherein elongated earth-embedded comparatively wide net-like sheets fabricated from a substantially non-corrosive metallic or synthetic material have their opposed ends rigidly anchored between pairs of spaced-apart stacked interlocking concrete beam elements.

Such connections depend upon gravity clamping pressures exerted by the stacked interlocking concrete beam elements upon the sandwiched edges of the soil reinforcing sheets extending therebetween which reduces, if not eliminates, any direct pressure contact between the contiguous surfaces of the interlocking concrete beam elements thereby reducing frictional forces between such elements which resist the relative displacement thereof and reinforce the integrity of the structure.

Also, such sandwiched net-like sheets permit seepage or entry and the collection of ground waters between the contiguous surfaces of the interlocking concrete beam elements which would promote deterioration of the contiguous surfaces of such elements, and, particularly, under freezing and thawing temperatures, impart greater instability to the stacked structure of such interlocking concrete beam elements, rendering such structure more vulnerable to shifting or overturning as a result of soil pressures from behind, as well as to loosening of the ties or connections between the tensioned sheets and interlocking concrete beam elements.

A more complex system using anchoring grids derived from sheets or strips of synthetic material comprised of longitudinally extending ribs intersected by transversely extending bars or ribs to be tied to a facing wall panel in an embankment reinforcing structure is disclosed by U.S. Pat. No. 4,728,227.

According to the aforementioned patent a piece or section of the grid-like material must first be cast into the facing wall panel with a segment thereof or tab portion extending therebeyond to establish one element for the connection of the soil reinforcing grid to such facing wall panel. The connection between the exposed grid-like segment or tab portion and the soil reinforcing grid is established by matching the longitudinally extending ribs thereof and by drawing one set of ribs through the other, creating an elongated channel for the reception of a separate rod which is adapted to be gripped and held within the elongated channel under tensioning imparted first by instrumentation extending between the facing wall and the soil reinforcing grid and then maintained through compaction of the earth or soil fill deposited behind the wall panels.

Such a connection between a synthetic grid-like piece or section and a cast concrete panel is inherently weak and under tension tends to deteriorate. Particularly, ground waters can penetrate the facing wall panel at the intersections between the pieces or sections of the grid-like material where they project from the concrete panel which will erode and deteriorate such connection.

OBJECTS OF THE INVENTION

Accordingly, the object of this invention is to provide an improved embankment reinforcing structure that includes a stable retaining wall or gravity facing wall derived from the combination of interlocking overlapping stackable facing wall units or blocks or panels and soil reinforcing elements in the form of sheets or strips of mesh-like or grid-like material wherein the facing wall and soil reinforcing elements can be more simply tied or connected together and, when installed, more securely held against separation as compared with known proposals and without impairing the integrity of the stacked interlocking facing wall units or panels or blocks.

More particularly the object of this invention is to provide an improved modular interlocking stackable facing wall panel or unit or block for a gravity retaining wall that will not only readily facilitate the tie or interconnection between the block and the soil reinforcing grid during the construction phase, but, when the facing wall is installed, substantially enclose or isolate the tie or connection within the facing wall and limit the access thereto, particularly ground water penetration which would deteriorate the tie or connection.

It is also an object of this invention to provide improved facing wall units or panels or blocks that include grid-engaging or grid-registering formations, so that the soil reinforcing grids can be securely tied or connected to such grid-engaging or grid-registering formations of such facing wall units or panels or blocks at selected intervals throughout the facing wall. Alternatively, depending upon the character of the particular embankment to be contained and stabilized, the improved blocks can be introduced only into those regions of the facing wall together with the grids to be tied or connected thereto where increased reinforcement is necessary or desirable with; compatible interlocking blocks used in the other regions of the facing wall to complete the installation.

Another important object of this invention is to provide greater latitude in settling upon a particular design for a gravity facing wall having regard to aesthetic and structural considerations, as, for example, where the gravity facing wall would be curved or arranged in angled sections or in combinations of curved, straight or angled sections and where the soil reinforcing grids could be introduced at various levels or in intersecting or overlapping relation to provide the requisite reinforcement and stabilization.

It is also an object to reduce the overall costs attributable to production, design, transportation and installation and so promote the adoption of such improved retaining wall systems and modular interlocking facing wall units or panels or blocks as an attractive alternative to those now known and utilized in this field.

FEATURES OF THE INVENTION

One feature of this invention resides in providing an interlocking facing block for a gravity retaining wall derived from like facing blocks stacked in interlocked and overlapped relation in horizontal courses and wherein such gravity retaining wall is adapted to be anchored against dislodgement by securing one or more appropriate suitably tensioned lengths of a selected tensioned soil reinforcing grid thereto to extend rearwardly into the embankment to be contained thereby in which the facing block has a body portion with an axis terminating in opposed end surfaces and bounded by front and rear facings and by generally parallel upper and lower surfaces, the body portion including a first recess extending axially thereof and opening to one of the upper and lower surfaces and presenting a projection formation extending axially thereof and upstanding from the other of said upper and lower surfaces, the first recess and projection formation having an overall configuration and extent so as to establish an interlock therebetween in axial sliding fit when respective upper and lower surfaces of like facing blocks are disposed in contiguous relation in stacked overlapped relation, the projection formation including means for interengaging with the grid edge section of a selected soil reinforcing grid presented thereto, and a further recess is included within at least one of the upper and lower surfaces and opening to at least the rear facing thereof and of an extent such that when like facing blocks are stacked in interlocked and overlapped relation with respective upper and lower surfaces thereof in contiguous relation the interengaged grid edge section of the selected grid length will be accommodated within such further recess.

Another feature of this invention resides in providing such a facing block in which the further recess has an extent within one of the respective upper and lower surfaces thereof so as to surround the grid interengaging means whereby a grid edge section can be fully registered thereover.

Still more particularly, a further feature resides in providing a block in which the aforementioned further recess has a substantially uniform depth and extent sufficient only to accommodate both the extent and thickness of the selected grid edge section to be secured thereto whereby respective surrounding upper and lower contiguous surfaces of the block can be presented for direct frictional and load bearing contact.

Thus can a connection or a tie be readily established between facing block and soil reinforcing grid, which connection or tie, when the succeeding courses of blocks are stacked thereupon to form a gravity retaining wall, is securely held against separation.

Still more particularly, it is a feature of the invention to provide a grid engaging formation or grid registering formation which includes at least a pair of projection portions so spaced apart as to protrude through and receive adjacent sections of a grid edge which when applied thereover will secure and align the grid edge section with the block. Thus it can be understood that in so providing a modular, stackable, interlocking facing block with such a grid engaging formation or grid registering formation, that a soil reinforcing grid may be secured thereto as each such block is stacked in a course within a gravity retaining or facing wall, for example throughout the lower course or at intervals throughout a course or spanning the ends of adjacent blocks in a course where in such an installation it would appear to be necessary or desirable.

Another feature of this invention resides in utilizing the upstanding projection portion of the grid engaging formation or grid registering formation of the improved block and the recess thereof as the elements for interlocking like blocks in stacked, retaining wall defining relation.

Another feature of this invention resides in providing the grid engaging formation or grid registering formation of the projection formation of the block integral with the body thereof.

Moreover, the grid engaging formation or grid registering formation of the projection formation of the block can be separable from the body thereof in another embodiment of the invention. In this embodiment the grid engaging formation or grid registering formation comprises at least a pair of spaced-apart dowels received within respective bores presented by the block.

Further, it is a feature of this invention that the further recess formation extends between the end surfaces and the front and rear facings of the block a sufficient distance to encompass therewithin the grid engaging or grid registering formation.

More particularly it is a feature of this invention to provide a block having the projection formation and the recess formation offset in relation to one another in the front to rear direction so that a retaining wall can be constructed that extends upwardly at an angle to the vertical.

Moreover, it is a feature of this invention to provide a soil reinforcing structure, and more particularly a gravity retaining wall that is tied to and anchored by tensioned soil reinforcing grid or mesh which extends rearwardly from such wall and into the embankment contained thereby.

More particularly, it is a feature of this invention to provide for a section of a soil reinforcing grid extending rearwardly from the rear surface of the wall into the embankment contained by the wall to overlap in frictional engagement with a section of a like soil reinforcing grid extending rearwardly from the rear surface of the wall and into the embankment.

Further, when such retaining wall is comprised of like interlocking blocks stacked in horizontal courses in substantially end-to-end relation to form a generally curved retaining wall such grid end section extending rearwardly from the rear surface of the wall into the embankment contained by the wall can overlap in frictional engagement a section of a like soil reinforcing grid extending rearwardly from the rear surface of the wall into the embankment and in the same plane as the first mentioned section of soil reinforcing grid.

Further, a retaining wall can be constructed comprised of like interlocking blocks stacked in horizontal courses forming adjacent wall sections extending at an angle to one another and joined at a common point or corner by like overlapping blocks from each wall section.

Moreover, where the angle between the wall sections of the retaining wall to contain the embankment is less than 180° any section of a soil reinforcing grid extending rearwardly from the rear surface of one of the wall sections and into the embankment contained by the wall can overlap in frictional engagement a section of a like soil reinforcing grid extending rearwardly from the rear surface of the other of the wall sections and into the embankment, particularly when the grid sections extend rearwardly from the respective wall sections in the same plane.

It is a feature of this invention that the frictional engagement between respective overlapping grid section ends allows localized loads to be distributed therebetween and transferred in different directions within the embankment itself.

Finally, it is a feature of this invention to provide a method for constructing an embankment reinforcing gravity facing wall derived from the aforementioned facing blocks interlocked and overlapped in sliding fit and tied to and anchored by a soil reinforcing grid extending rearwardly therefrom into the embankment so contained, which method comprises the steps of:

a) excavating the soil to a selected depth and providing a generally horizontally extending base suitable to support the gravity facing wall;

b) laying upon the base one or more courses of like interlocking facing wall blocks used in constructing the gravity facing wall at least some of which present upstanding grid interengaging formations and associated recess formations for the reception of a grid edge section of a selected length of reinforcing grid to be secured thereto;

c) securing to a selected upstanding grid interengaging formation presented by certain of the blocks an edge section of a selected length of soil reinforcing grid in one or more regions of the course where the soil reinforcing grid is to extend into the embankment;

d) laying a superior course of like interlocking facing wall blocks in contiguous relation upon the facing wall blocks of the lower course with the blocks in the superior course arranged so that they overlap the blocks in the inferior course and in interlocking sliding fit therewith and confine the respective secured edge section within the aforementioned associated recess formations;

e) laying out the respective length of soil reinforcing grid so secured to extend rearwardly therefrom and upon backfill delivered to that region and compacting same; and f) repeating the aforementioned steps in sequence so as to establish an anchored gravity facing wall structure up to a selected height and to thereby reinforce the compacted soil embankment contained thereby.

The final step to complete the gravity facing wall is to lay a course of interlocking coping blocks in interlocking relation with the uppermost course of interlocking facing wall blocks in the gravity facing wall, and with the coping blocks arranged so that those coping blocks overlaying interlocking facing wall blocks in the course therebelow which secure thereto an edge section of a soil reinforcing grid define therebetween associated recess formations for confining therewithin the edge section of the soil reinforcing grid.

DESCRIPTION OF THE INVENTION

These and other features of the invention are outlined in the following description to be read in conjunction with the sheets of drawings in which.

Figure 2:
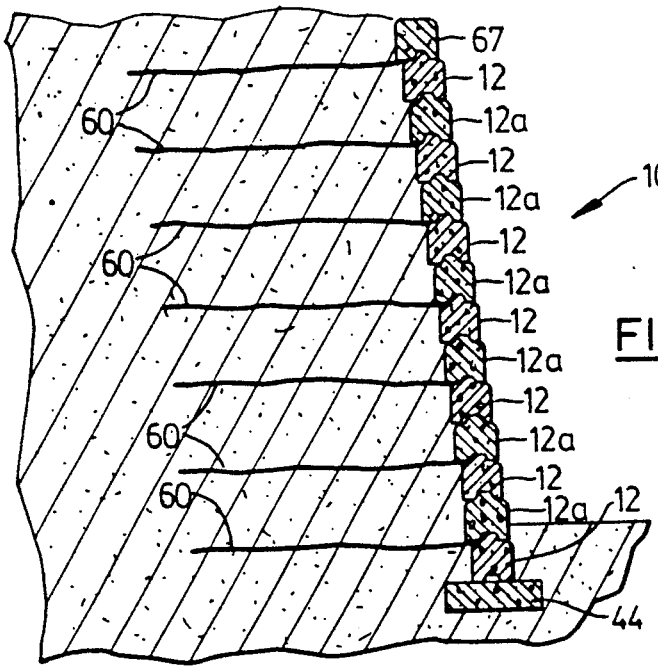
FIG. 2 is a side elevational cross-sectional view of an embankment reinforcing structure including a gravity retaining wall tied to and anchored by layered mesh or grid, the gravity retaining wall comprised of stacked concrete facing wall units or blocks, and corresponding coping blocks, together with an appropriate footing.
Figure 3:
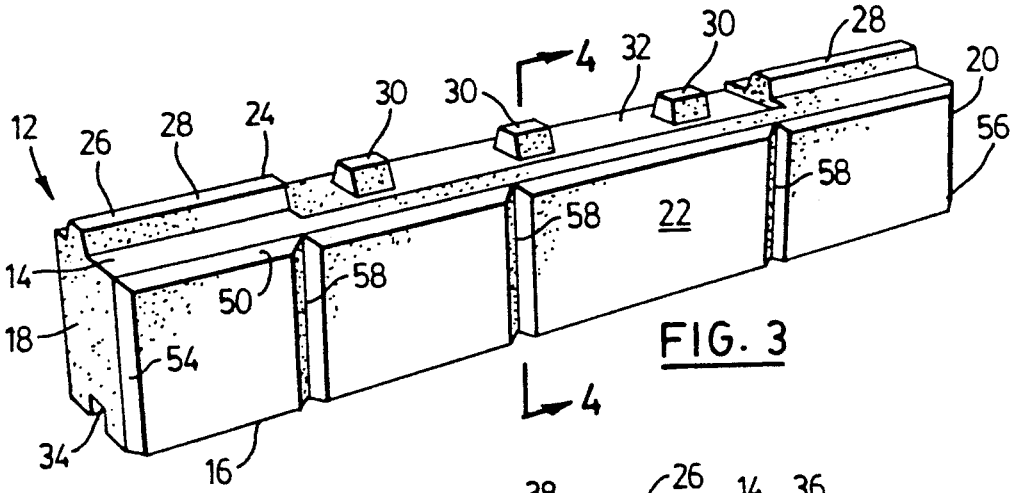
Figure 4:
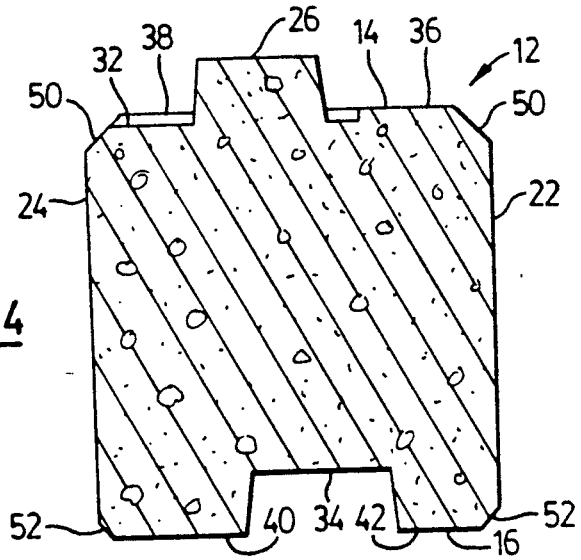
Figure 2A:
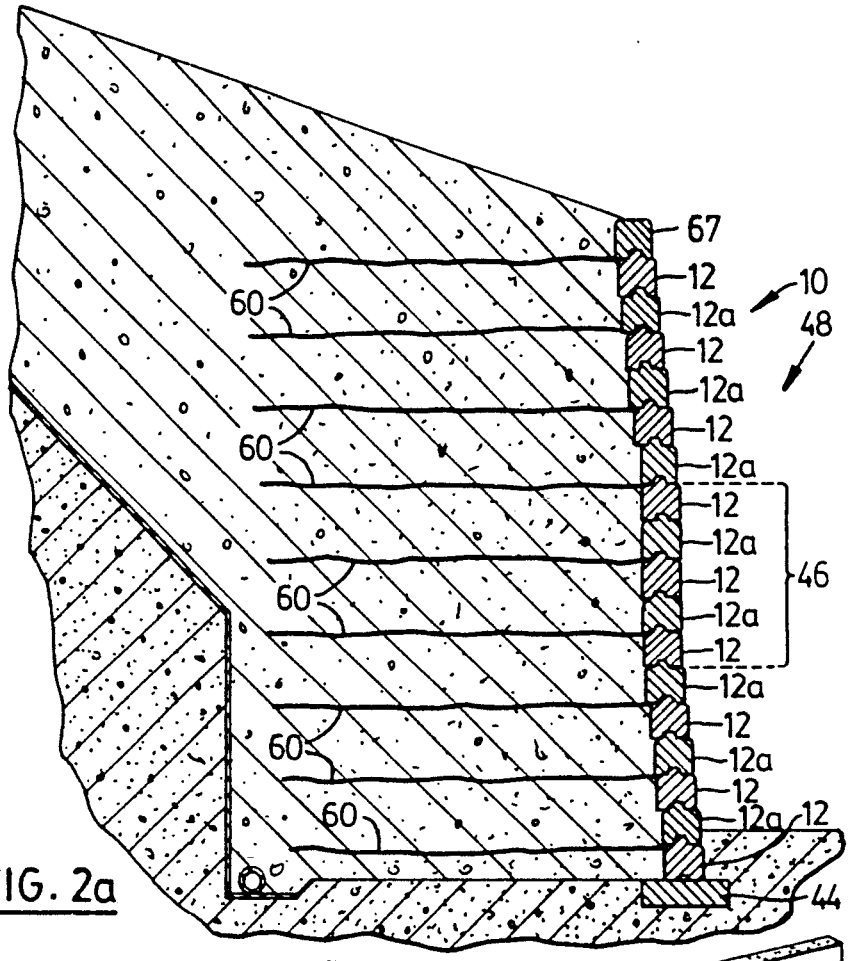
Figure 3A:
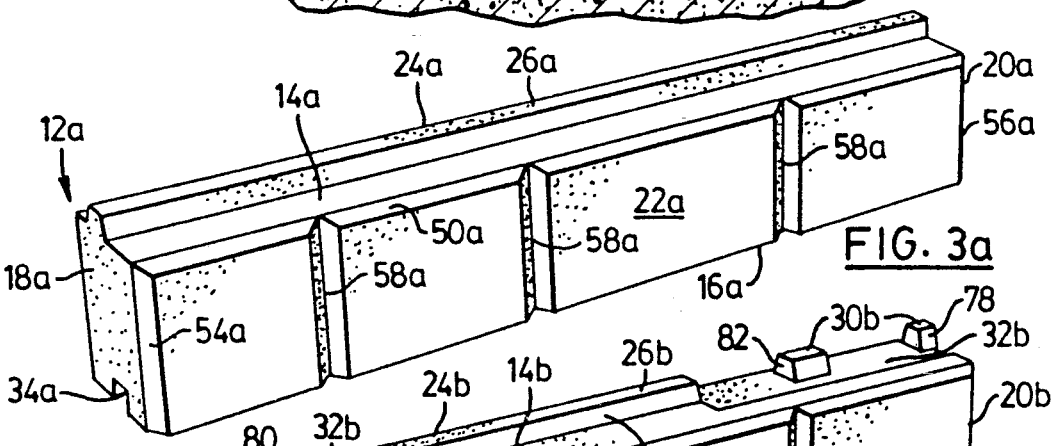
Figure 3B:
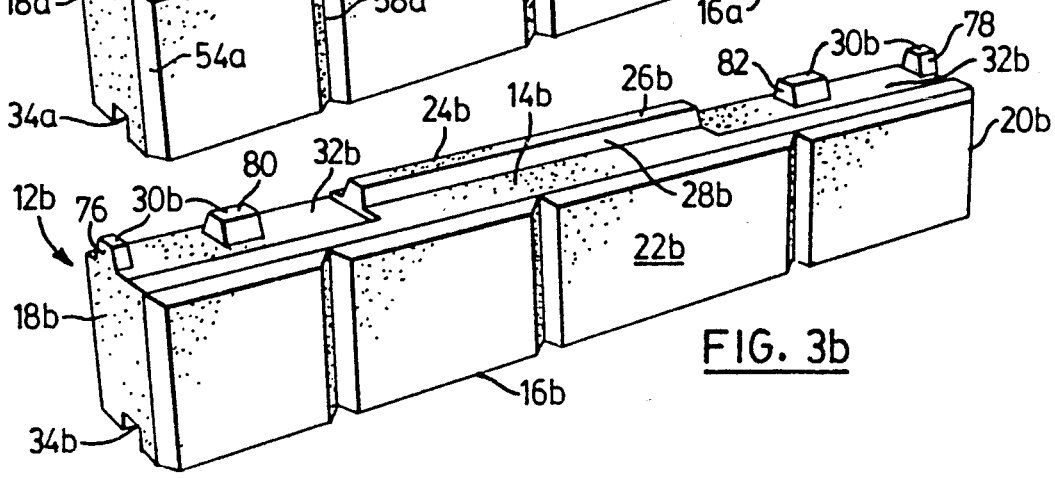
Figure 3C:
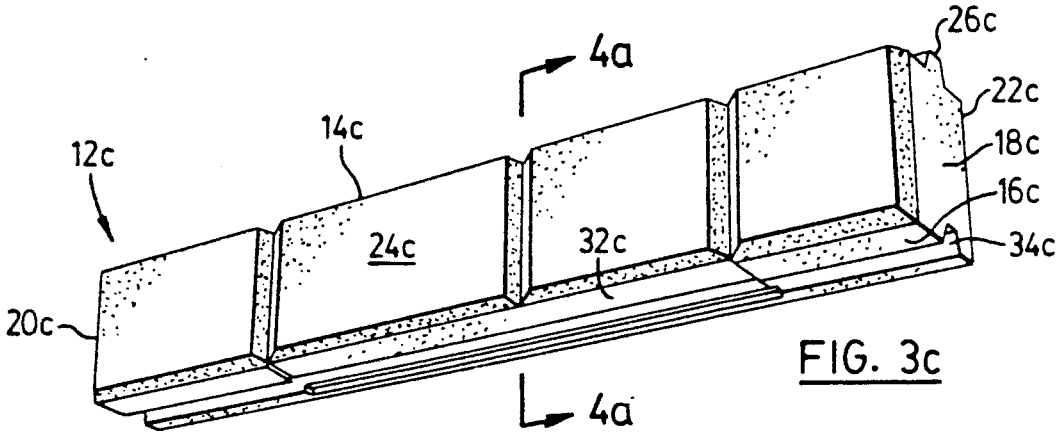
Figure 4A:
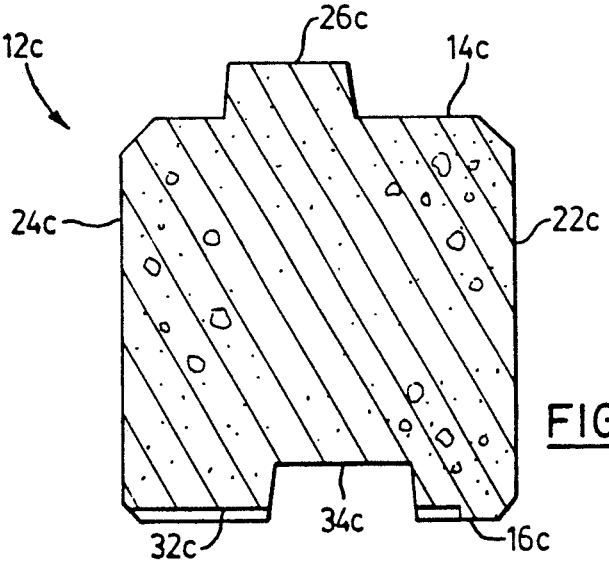
Figure 3D:
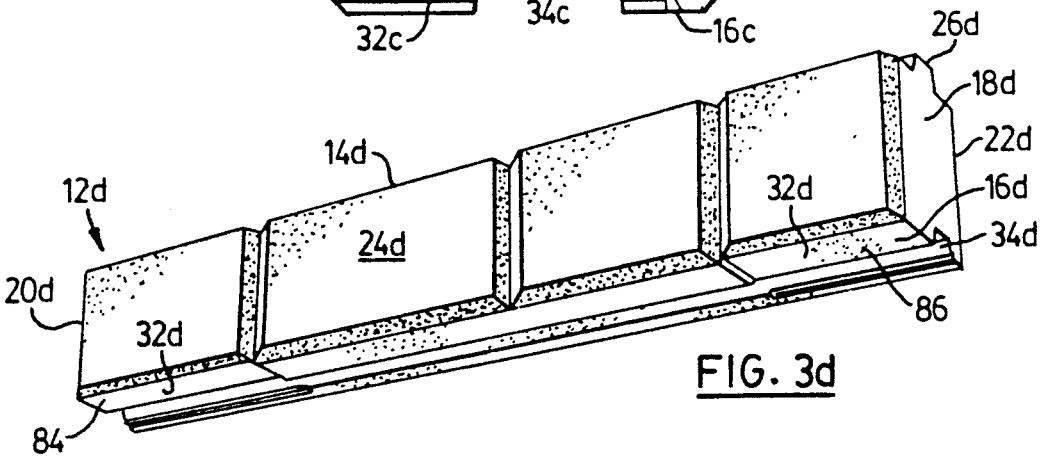
Figure 5:
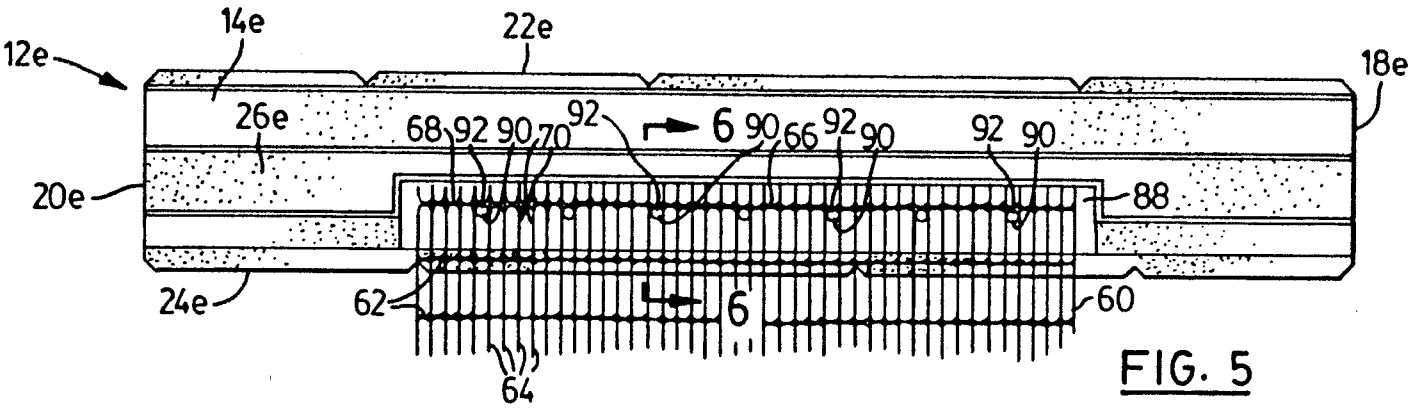
Figure 6:
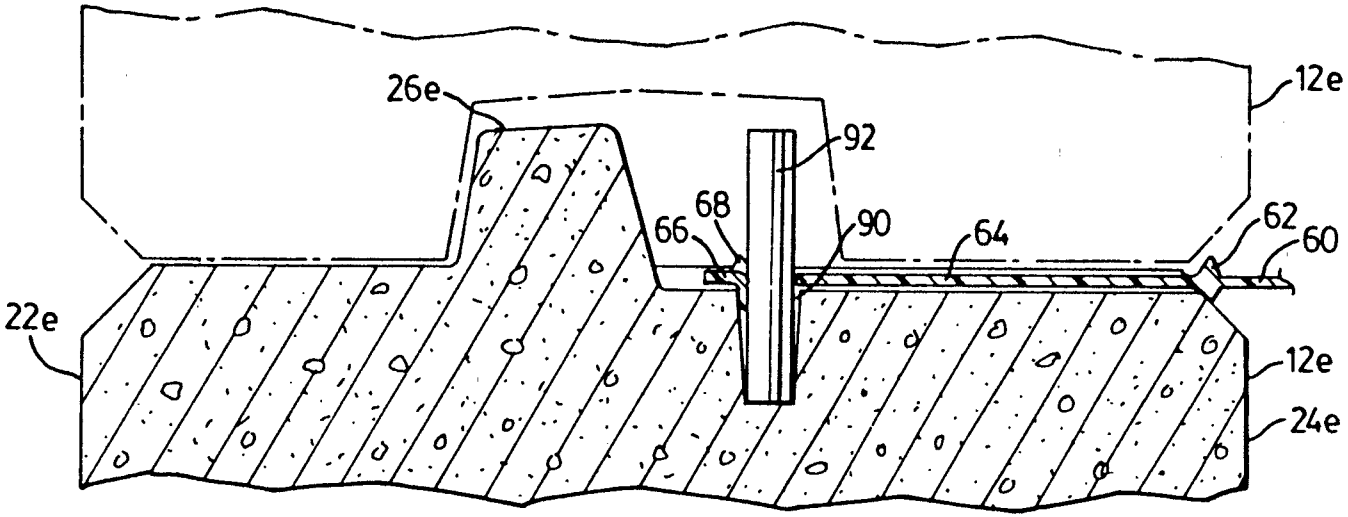
Figure 7:
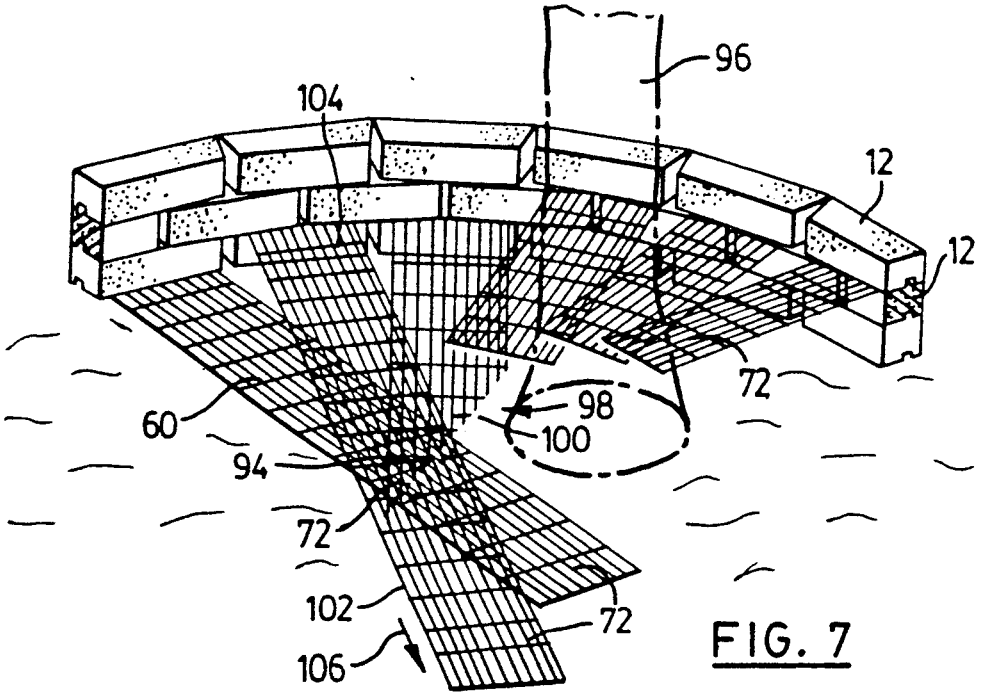
Figure 8:
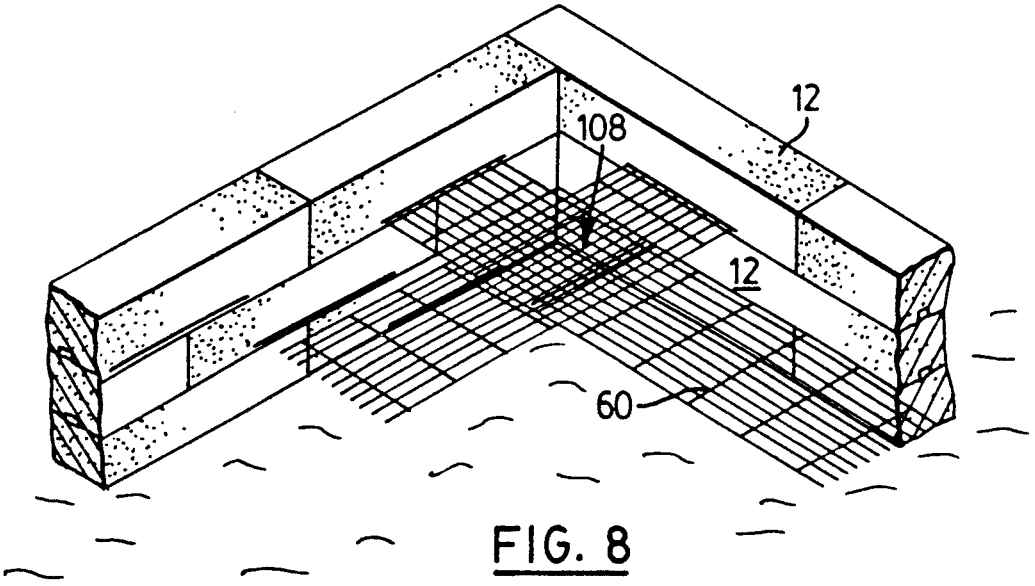

FIG. 2*a* is a side elevational cross-sectional view of an embankment reinforcing structure including a gravity retaining wall tied to and anchored by layered mesh or grid as in FIG. 2, however, the gravity retaining wall extends upwardly both at a selected angle to the vertical, and substantially vertical in selected regions thereof;

FIG. 3 is a perspective view of the facing wall unit or block used in constructing gravity retaining walls illustrating along the upper surface thereof the grid engaging or grid registering formations;

FIG. 3*a* is a perspective view of a compatible companion facing wall unit or block used in constructing gravity retaining walls, and particularly used when the mesh or grid is not to be tied or connected to the gravity retaining wall in that region;

FIG. 3*b* is a perspective view of an alternative embodiment of the facing wall unit or block illustrating along the upper surface and at either ends thereof the grid engaging or grid registering formations;

FIG. 3*c* is a perspective view of a further alternative embodiment of the facing wall unit or block illustrating along the lower surface thereof a recess or depression for confining therein the mesh or grid;

FIG. 3*d* is a perspective view of yet a further alternative embodiment of the facing wall unit or block illustrating along the lower surface and at either ends thereof the recess or depression for confining therein the mesh or grid;

FIG. 4 is a side cross-sectional view of the facing wall unit or block of FIG. 3 taken along the lines 4—4 thereof;

FIG. 4*a* is a side cross-sectional view of the facing wall unit or block of FIG. 3*c* taken along the lines 4*a*—4*a* thereof;

FIG. 5 is a top elevational view of a further embodiment of the invention illustrating yet a further facing wall unit or block having a modified grid engaging or grid registering formation adapted to secure the mesh thereto through the use of pins or dowels;

FIG. 6 is a side cross-sectional view taken along lines 6—6 of FIG. 5 of the further embodiment illustrated and particularly illustrating the tying or connection of the mesh to the facing wall unit or block by pins or dowels;

FIG. 7 is a perspective view of the invention illustrating a curved embankment reinforcing gravity retaining wall including facing wall units or blocks stacked in courses tied to and anchored by layered mesh or grid particularly arranged in a given plane and extending back into the embankment and overlapping so as to frictionally engaged one another; and FIG. 8 is a perspective view of the invention illustrating a corner of an embankment reinforcing gravity retaining wall including facing wall units or blocks stacked in overlapping courses tied to and anchored by layered mesh or grid again particularly arranged in a given plane and extending back into the embankment and overlapping so as to frictionally engage one another.

THE FACING WALL UNITS OR BLOCKS

Figure 1:
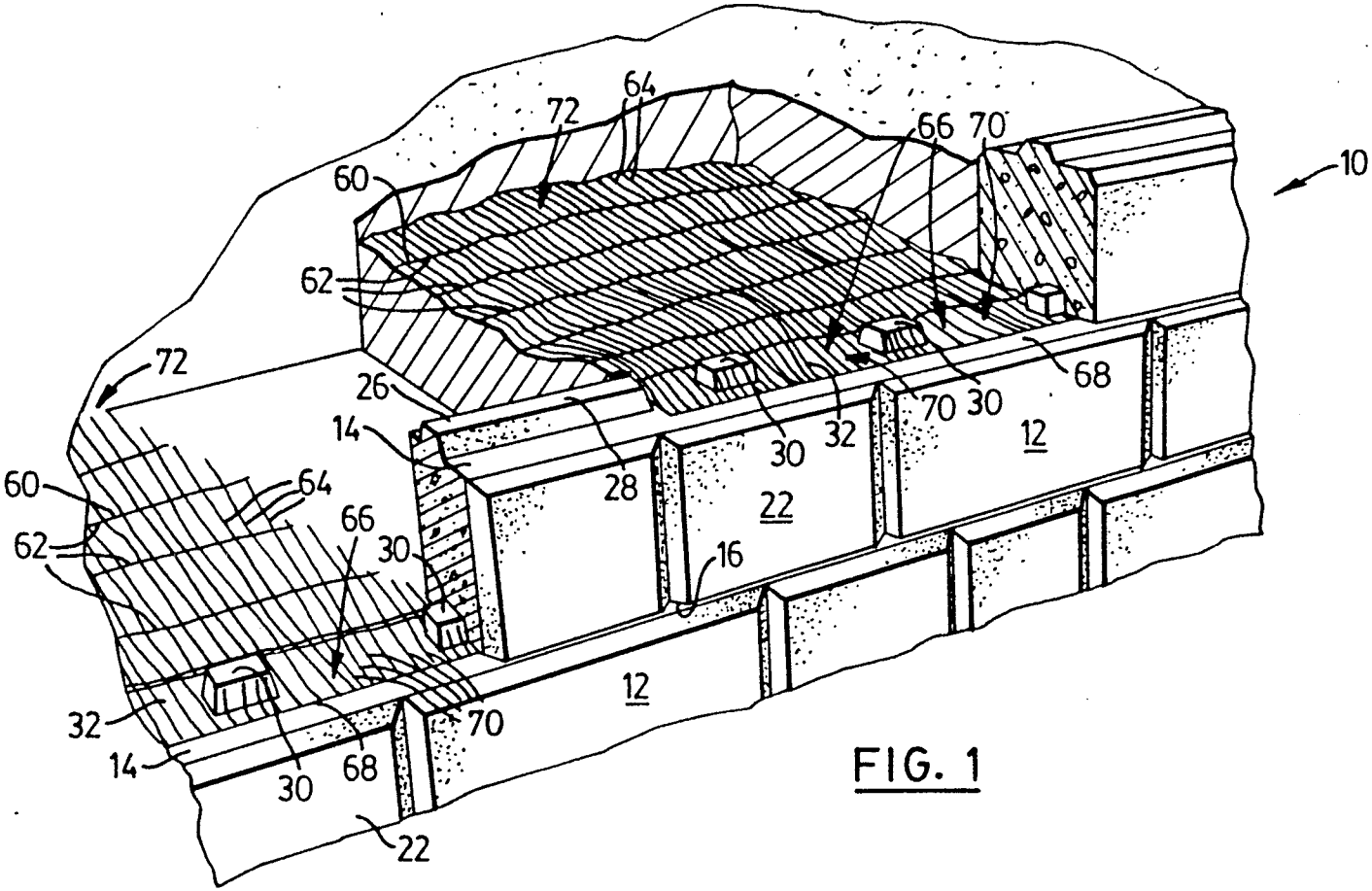
FIG. 1 is a perspective view of the invention illustrating an embankment reinforcing structure including a retaining wall or gravity facing wall including facing wall units or blocks stacked in overlapping courses and layered mesh or grid to anchor the soil, and partly cut away to reveal the tie or connection of the mesh or grid to the grid engaging formations of the facing wall units or blocks.

The gravity retaining wall or gravity facing wall 10 of the improved embankment reinforcing structure illustrated in FIGS. 1 and 2 of the drawings is derived primarily from appropriately stacked interlocking facing wall units or blocks 12 arranged in horizontal courses and in contiguous relation to one another, as depicted in perspective in FIG. 3 and depicted in cross-section in FIG. 4.

The body of blocks 12 is preferably generally parallelogrammatical in configuration and is bounded by generally parallel upper and lower surfaces 14, 16, respectively, a longitudinal axis terminating in respective opposed end surfaces 18, 20, and front and rear facings 22, 24, respectively.

In the embodiment illustrated facing wall units or blocks 12 are preferably derived from concrete and have dimensions of the order of 1'×1'×6'. A facing wall unit or block 12 of such dimensions constructed from concrete would weigh of the order of 800 lbs. It can be appreciated, however, that facing wall units or blocks 12 of various dimensions, configurations, and weights can be constructed as required to reinforce particular embankment backfills and meet the demands for an aesthetically pleasing gravity retaining wall without departing from the spirit of the invention described herein and claimed.

Longitudinally axially extending projection or tongue formation 26 upstands from upper surface 14 of block 12 and includes elongated segments 28, extending inwardly from each of end surfaces 18, 20, respectively, and separated by uniformly spaced projections 30 therebetween.

Upper surface 14 of blocks 12, in the preferred embodiment, also includes therein a recess or depression 32 extending between elongated segments 28 and of a sufficient depth to accommodate the thickness of the mesh or grid-like material, which depression opens to rear facing 24 of facing wall unit or block 12 and terminates forwardly of spaced projections 30. It can be appreciated from FIG. 3 that recess or depression 32 has a perimetric extent so as to encompass therewithin spaced projections 30.

Longitudinally axially extending mating recess 34 opens to the lower surface 16 of block 12 and, in the preferred embodiment, is offset in relation to elongated projection or tongue formation 26.

The body of each block 12 is dimensioned so that the front-to-back extent of upper surface portions 36, 38, respectively, match the back-to-front extent of lower surface portions 40, 42, respectively, as best illustrated in FIG. 4. Thus, when facing wall units or blocks 12 are stacked in interlocked relation upon a suitable footing which includes a course of levelling blocks 44, as depicted in FIG. 2, each successive course of facing wall units or blocks 12 will be slightly uniformly set back from the next below course so that the gravity facing wall 10 constructed is uniformly angled to the vertical, and preferably within a range of between 7° to 10°.

A retaining wall block having such offset structure and a gravity facing wall uniformly angled to the vertical and derived from retaining wall blocks featuring projection or tongue formations in the upper surface offset to the corresponding recess in the lower surface is disclosed by U.S. Pat. No. 4,490,075.

It is to be understood that projection or tongue formation 26, in the preferred embodiment, and as illustrated in FIGS. 1 and 3, presents a series of spaced-apart projections 30, or otherwise grouped as may be specified, to engage or register thereover soil reinforcing elements of mesh or grid-like material to be tied or connected thereto, as will hereinafter be detailed.

When the facing wall units or blocks 12 are stacked in the arrangement illustrated in FIG. 2*a* with each successive course of blocks 12 in a region 46 thereof reversed in relation to the course next below, the resulting facing wall 48 so constructed extends substantially vertically in that region.

Such a gravity retaining wall extending substantially vertically and derived from an arrangement of facing wall units or blocks 12 featuring a projection or tongue formation in the upper surface offset to the mating recess in the lower surface is disclosed in U.S. Pat. No. 4,815,897.

Further, it can be appreciated that the reversing of each successive course of blocks to create vertical region 46 illustrated in FIG. 2*a* could be repeated so that the entire facing wall extends substantially vertically upwardly.

Since, for aesthetic reasons the surface treatment of the exposed facing wall 48 of FIG. 2*a* will likely be desired to appear uniform, compatible companion blocks 12*a*, as best illustrated in FIG. 3*a*, can be introduced into the alternate course of the gravity facing wall 48, and particularly in substantially vertical region 46, which companion blocks 12*a* omit recess or depression 32 of facing wall units or blocks 12 and, preferably, feature a projection or tongue formation 26*a* extending substantially continuous between end surfaces 18*a*, 20*a*; the benefits derived from using such compatible companion blocks to be disclosed hereinafter.

So far as surface treatment is concerned, facing wall units or blocks 12 and 12*a* are preferably bevelled as at 50 and 52 and 50*a*, 52*a*, respectively, along the upper and lower edges, and bevelled at 54, 56 and 54*a*, 56*a*, respectively, along the end edges of both front and rear facings 22, 24 and 22*a*, 24*a*, respectively. The front and rear facings themselves can also have a surface design or pattern otherwise applied thereto, and, as illustrated for facing wall units or blocks 12 and 12*a*, in the form of vertically extending suitably spaced apart V-shaped grooves 58, 58*a*, respectively, which intersect with the respective bevelled surfaces 50, 52, and 50*a*, 52*a*. This surface treatment is by no means controlling and many other patterns can be applied to the facings of the blocks or facing wall units to meet individual tastes.

THE SOIL REINFORCING ELEMENTS

The sheets or strips of mesh or grid-like material, identified as 60 in FIGS. 1, 2, and 2*a* of the drawings, are available for soil or slope reinforcing and include two principal types: uniaxial or high tensile strength in one direction only, and biaxial with tensile strength in two directions perpendicular to each other.

Uniaxial grids are used for substantial as well as steep slope reinforcement and are usually placed in a horizontal disposition extending inwardly at right angles to the direction of the embankment or the gravity facing wall of the embankment reinforcing structure.

Biaxial grids are light in weight and therefore have a lower tensile strength suitable for smaller or less steep embankments and can serve as an intermediate reinforcement between uniaxial soil reinforcing grids or in conjunction with them, depending upon the conditions encountered.

Mesh or grid-like material 60 illustrated in FIG. 5 of the drawings is an uniaxial grid and includes suitably spaced-apart transversely extending bars 62 of a greater cross-section as compared with the longitudinally extending ribs 64 arranged in uniformly spaced-apart relation and joining transversely extending bars 62 together.

The biaxial grids (not illustrated) include transverse ribs uniformly spaced apart and longitudinal ribs uniformly spaced apart and joined together at their intersection and having a comparable cross-section to one another.

Preferably the grids, either biaxial or uniaxial, are derived from high density polyethylene or polypropylene, both of which strongly resist chemical or biological attack and can withstand substantial physical abuse, are stabilized to withstand long periods of exposure to sunlight, and will function at both high and low temperature extremes.

Such products are now available in different grid configurations and in a range of tensile strengths under the trademark TENSAR, which are supplied in rolls for delivery to the site, and appropriately measured sheets or strips of selected widths and lengths can be severed therefrom as required during the installation of the embankment reinforcing structure.

THE RETAINING WALL SYSTEM

A gravity facing wall constructed of facing wall units or blocks 12 and, where such facing wall units or blocks 12 are not required, of compatible companion facing wall units or blocks 12*a*, is illustrated in FIGS. 2 and 2*a*.

In constructing a gravity facing wall as illustrated the soil is first excavated and a granular compacted base provided for the first course of levelling blocks 44 to be laid out, either at a selected angle in relation to the horizontal, or, as in the preferred embodiment where facing wall units or blocks 12 and 12*a* feature projection or tongue formations 26, 26*a* offset in relation to recesses 34, 34*a*, respectively, levelled in all directions, all as well known in the art and particularly shown by Canadian patent no. 941,626, and U.S. Pat. Nos. 4,490,075, and 4,815,897.

Each successive or superior course comprised of facing wall units or blocks 12 and 12*a*, as required, are stacked end-to-end in axial sliding fit upon the next below or inferior course in interlocked overlapping relation therewith. The appearance of the facing wall is finished by providing a last course of coping blocks 67 uppermost, which blocks include therein a recess on the lower surface thereof to receive the projection or tongue formations presented by the course therebelow, but themselves do not present tongue or projection formations upstanding from their upper surfaces.

To tie the mesh or grid 60 to the gravity facing wall the upper surfaces 14 of facing wall units or blocks 12 in a selected course where mesh or grids 60 are required are revealed as in FIG. 1, to expose the spaced projections 30 of projection or tongue formations 26.

Edge portions 66 of uniaxial mesh or grids 60 are shown overlying the exposed spaced projections 30 of each of blocks 12, with transverse bars 62 of mesh or grids 60 aligned with the longitudinal axes of facing wall units or blocks 12 and with longitudinally extending ribs 64 of mesh or grids 60 extending at right angles thereto into the embankment.

Longitudinally extending ribs 64 of mesh or grids 60 extending between spaced-apart transverse bars 62 in the regions overlying spaced projections 30 are severed with sections of the ribs removed, whereby the several spaced projections 30 of facing wall units or blocks 12 protrude through mesh or grids 60 where such sections of longitudinally extending ribs 64 are removed.

The length of the particular sheet or strip of mesh or grid 60 engaged by or registered over spaced projections 30 so as to be tied or connected thereto of any one facing wall unit or block 12 can be determined on sight and suited to the nature of the fill or other considerations, such as soil or climatic conditions, that apply to the particular installation.

It will be observed that recess or depression 32 in upper surface 14 of facing wall unit or block 12 underlying grid edge portion 66 is recessed to a depth sufficient to accommodate the thickness of mesh or grid 60, and, in the preferred embodiment, to a depth sufficient to completely confine the thickness of mesh or grid 60 therewithin. Recess or depression 32 opens along rear facing 24 of facing wall unit or block 12 and terminates forwardly of spaced projections 30 a distance sufficient to accommodate at least the width of transverse bar 68 of the grid section applied thereover.

The dimension of recess or depression 32 measured longitudinally of the block is selected in relation to elongated segments 28 and spaced projections 30 of projection or tongue formation 26 of block or facing wall unit 12 so as to present at least several longitudinal rib segments 70 beyond and between those rib segments that have been severed in order to receive projections 30 protruding therethrough and preserve the high tensile modulus imparted to the soil reinforcing grid.

Thus it will be seen that spaced projections 30 of facing wall units or blocks 12 in the preferred embodiment are encompassed or upstand within the perimeter of recess or depression 32.

Moreover, it will also be obvious that recess or depression 32 in accommodating mesh or grid 60 applied over spaced projections 30 allows adjacent portions of upper surfaces 14 of adjacent blocks 12 to be exposed for direct pressure contact with the overlying contiguous lower surfaces 16 of adjacent facing wall units or blocks of the superior course. Such utilizing of the strong forces of friction in this region of direct pressure contact resists lateral displacement of the blocks in overlapping courses in relation to one another and thereby promotes the integrity of the gravity facing wall installation.

It is to be noted that the number of spaced projections 30 of facing wall units or blocks 12 can be varied or other types of mesh or grids, for example biaxial grids, substituted for the uniaxial grids illustrated having different characteristics in terms of strength as well as the character of the interlock of the grids with the earth or soil, to create the continuously reinforced earthen or soil mass required.

Ends 72 of soil reinforcing mesh or grids 60 extending horizontally from the gravity facing wall and into the embankment can be anchored by driving stakes through the ends of mesh or grids 60 in the embankment into the backfill, but, if the sheets or strips of mesh or grids 60 are rolled out upon the backfill which is at a level of the course being installed and rolled rearwardly so as to be laid thereupon, and another course applied to the facing wall and backfill deposited, forces develop within such soil mass as to immediately pull sheets or strips of mesh or grids 60 into tension and not only anchor the facing wall itself, but transfer the forces from the unstable soil backfill into less stressed portions, whereby the stability of the embankment is enhanced.

The compatible facing wall unit or block 12*a* illustrated in FIG. 3*a* like block 12 has a block body of generally parallelogrammatical configuration defined by upper and lower surfaces 14*a*, 16*a*, respectively, front facings and rear facings 22*a*, 24*a*, respectively, and a longitudinal axis terminating in respective opposed end surfaces 18*a*, 20*a*, and includes an axially extending projection or tongue formation 26*a* upstanding from upper surface 14*a* and an axially extending offset recess formation 34*a* within lower surface 16*a*.

Projection or tongue formation 26a of upper surface 14a of facing wall unit or block 12a is continuous throughout the longitudinal extent of same.

Further, there is no recess or depression found in such block as recess or depression 32 in facing unit or block 12.

Therefore, in constructing a gravity retaining wall for an embankment, if it is determined that soil or climatic conditions do not require strips or sheets of mesh or grid 60 to be positioned at every course or such sheets or strips of mesh or grid 60 are not required along a certain region of a given course, then compatible companion facing wall units or blocks 12a can be substituted for facing wall units or blocks 12. By using facing wall units or blocks 12a in regions where sheets or strips of mesh or grid 60 are not required no opening or access between the intersection of successive courses of facing wall units or blocks is presented for the penetration and collection of run-off moisture; such opening or access would normally be presented at the intersection between successive courses of facing wall units or blocks by recess or depression 32 in upper surface 14 of facing wall units or blocks 12 which opens to rear facing 24 of such facing wall units or blocks.

Further, in constructing a retaining wall having a facing wall extending substantially vertically, or including a region 46 extending substantially vertically, as in facing wall 48 illustrated in FIG. 2a, where such facing wall units or blocks of successive courses are reversed, by using compatible companion facing wall units or blocks 12a no opening or access between the intersection of successive courses of facing wall units or blocks would be presented to the front of facing wall 48 for the introduction and collection of moisture; again, such opening or access to the front of the facing wall would normally be presented at the intersection between successive courses of facing wall units or blocks by recess or depression 32 in upper surface 14 of facing wall unit or block 12 which opens to rear facing 24 of such block, upon reversing successive courses of facing wall units or blocks in constructing substantially vertical region 46 in gravity facing wall 48.

Moreover, the use of reversed compatible facing wall units or blocks 12a in constructing a substantially vertical region 46 in gravity facing wall 48, or a gravity facing wall vertical throughout its entire extent, ensures that the front facing of such wall is substantially uniform in appearance throughout the extent of the wall. As can be appreciated from FIGS. 3, 3a, and 4, front and rear facings 22a, 24a, respectively, of compatible companion facing wall units or blocks 12a are identical to front facings 22 of facing wall units or blocks 12.

It can be appreciated, however, that should soil conditions require in constructing gravity facing walls that such walls extend upwardly uniformly vertically that layered grid-like sheets or strips be used at every successive course, or at a particular course where normally reversed compatible companion facing wall units or blocks 12a would be used, then a modified form of facing wall unit or block 12 can be provided wherein recess or depression 32 opens forwardly to front facing 22 of facing wall unit or block 12 and terminates rearwardly of spaced projections 30 so that when such modified facing wall unit or block is reversed in constructing the vertical gravity facing wall the grid-like sheets or strips so secured to such modified block extend into the backfill while the front facing of the retaining wall presents an uniform facade.

Finally, should a gravity facing wall be constructed as in FIG. 2, and no companion or compatible facing wall units or blocks 12a are available, then recess or depression 32 in facing wall units or blocks 12 can be provided with a slight incline descending towards rear facing 24 thereof so that in those regions of gravity facing wall where mesh or grid 60 is not required moisture run-off does not collect in the access or opening to the rear of such wall presented by recess or depression 32 at the intersection between successive courses of facing wall units or blocks.

A further modification to facing wall unit or block 12a is illustrated in FIG. 3b. Facing wall unit or block 12b illustrated includes a body of generally parallelogrammatical configuration having an upper surface 14b, a lower surface 16b, a longitudinal axis terminating in respective opposed end surfaces 18b, 20b, and front and rear facings 22b, 24b, respectively.

Upper surface 14b of facing wall unit or block 12b includes an axially extending projection or tongue formation 26b extending between respective end surfaces 18b, 20b along the longitudinal axis of the block. Projection or tongue formation 26b includes an elongated segment 28b extending centrally thereof and, at either end, respective spaced projections 30b. Recess or depression 32b in facing wall unit or block 12b is of sufficient depth to accommodate the thickness of mesh or grid 60 as in recess or depression 32 of facing wall unit or block 12 and extends longitudinally of the block on either side of elongated segment 28b and opens to respective end surfaces 18b, 20b and to rear facing 24b of block 12b, and terminates forwardly of spaced projections 30b. As with the spaced projections of facing wall unit or block 12 illustrated in FIG. 3, the spaced projections 30b are entirely encompassed by the perimeter of recess or depression 32b.

Further, in the embodiment illustrated in FIG. 3b, respective end projections 76, 78 of spaced projections 30b extend half the normal length of spaced projections 80, 82. When two facing wall units or blocks 12a are placed in end-to-end relation respective half projections 76, 78 combine to present a spaced projection of similar dimensions to spaced projections 80, 82. Recesses or depressions 32b, opening to respective end surfaces 18b, 20b, would combine to form a single recess or depression whose perimeter encompasses the combined spaced projections presented by facing wall units or blocks 12b so positioned in end-to-end relation. Consequently, it can be appreciated that facing wall units or blocks 12b arranged in end-to-end relation present a series of spaced projections 30b, comprised of spaced projections 80, 82, and respective adjacent half projections 76, 78, and half recesses or depressions 32 which combine to form a series of spaced projections encompassed by a recess depression substantially identical to the relation of spaced projections 30 and recess or depression 32 shown by facing wall units or blocks 12 in FIG. 3.

It can also be appreciated that facing wall units or blocks 12 and 12b can be constructed without depressions 32 and 32b in upper surfaces 14 and 14b, respectively. In constructing a gravity facing wall utilizing such facing wall units or blocks, however, a recess or depression to accommodate the thickness of mesh or grid 60 will have to be provided in the lower surfaces of compatible facing wall units or blocks in the course thereabove so that mesh or grid 60 can be preferably confined therewithin. Such facing wall units or blocks featuring a recess or depression in the lower surface are illustrated in FIGS. 3c, 3d, and 4a, with like reference characters referring to corresponding structure found in facing wall units or blocks 12 as illustrated in FIGS. 3 and 4.

Axially extending projection or tongue formations 26c and 26d of facing wall units or blocks 12c and 12d, respectively, can be of the form illustrated in FIG. 3, wherein spaced projections 30 extend longitudinally of facing wall unit or block 12 between elongated segments 28, or of the form illustrated in FIG. 3a, wherein the tongue formation is continuous in its longitudinal extent, or of the form illustrated in FIG. 3b, wherein spaced projections 30b extend longitudinally of facing wall unit or block 12b on either side of elongated segment 28b.

Recess or depression 32c of facing wall unit or block 12c is presented in lower surface 16c extending longitudinally of the axis of the facing wall unit or block and centrally thereof and which recess or depression opens to rear facing 24c of facing wall unit or block 12c and terminates forwardly of axially extending recess 34c.

In facing wall unit or block 12d recess or depression 32d presented in lower surface 16d is separated into half recesses or depressions 84, 86 extending longitudinally of facing wall unit or block 12d at either end thereof. Half recesses or depressions 84, 86 of recess or depression 32d open to rear facing 24d and to respective end surfaces 18d, 20d of facing wall unit or block 12d and terminate forwardly of axially extending recess 34d.

It can be appreciated that when facing wall units or blocks 12d are placed in end-to-end relation respective half recesses or depressions 84, 86 combine to form a single depression of similar extent to depression 32c of facing wall units or blocks 12c.

It can be appreciated that in constructing a gravity facing wall comprised of facing wall units or blocks arranged in overlapping courses and particularly facing wall units or blocks presenting spaced projections as illustrated in FIG. 3b (but without the recess or depression) that a facing wall unit or block 12c would be required; recess or depression 32c of facing wall unit or block 12c in lower surface 16c would encompass the combined spaced projections so presented therebelow by adjacent facing wall units or blocks in end-to-end relation while allowing facing wall units or blocks 12c to overlap such blocks and retain the integrity of the gravity facing wall.

Facing wall units or blocks in a lower course which present the spaced projections between the elongated segments as illustrated in FIG. 3 (but without the recess or depression) would require facing wall units or blocks 12d in an upper course; recesses or depressions 32d of facing wall units or blocks 12d would, when such facing wall units or blocks are arranged in overlapping relation to the facing wall units or blocks in the lower course, encompass the spaced projections extending between elongated segments so presented.

FIGS. 5 and 6 illustrate a further embodiment of the invention wherein a facing wall unit or block 12e has a block body of generally parallelogrammatical configuration defined by upper and lower surfaces 14e, 16e, respectively, a longitudinal axis terminating in respective opposed end surfaces 18e, 20e, and front and rear facings 22e, 24e, respectively, with an axially extending projection or tongue formation 26e upstanding from upper surface 14e, and an axially extending offset recess formation 34e within lower surface 16e.

Projection or tongue formation 26e of upper surface 14e of facing wall unit or block 12e centrally of the longitudinal extent of same is modified so as to remove or eliminate a rearwardly disposed portion 88 of projection or tongue formation 26e. Facing wall units or blocks 12e are also provided with a recess or depression 32e within upper surface 14e thereof for the reception therewithin of an edge section 66 of sheets or strips of mesh or grid 60 to be tied or connected thereto.

Within portion 88 of projection or tongue formation 26e that has been removed facing wall unit or block 12e is provided with a series of bore holes 90 adapted to be fitted with pins or dowels 92 derived from fibreglass or other synthetic materials. Bore holes 90 are suitably spaced apart so when mesh or grid edge section 66 of sheets or strips of mesh or grid 60 are received and confined within depression 32e pins or dowels 92 protrude through grid 60 between adjacent ribs. When mesh or grid 60 is placed under tension transverse bar 68 bears against pins or dowels 92 as best illustrated in FIG. 6.

When facing wall units or blocks of the superior course are mounted or stacked upon facing wall units or blocks 12e of the inferior course to which soil reinforcing sheets or strips of mesh or grids 60 have been applied and secured by introducing the several pins or dowels 92 into respective bore holes 90, as illustrated in FIGS. 5 and 6 of the drawings, it will be observed that pins or dowels 92 are captured or confined within recess 34e presented by or extending within lower surface 16e of the overlying facing wall units or blocks 12e.

Facing wall units or blocks of successive courses illustrated in FIGS. 5 and 6, as in the case of facing wall units or blocks of successive courses illustrated in FIGS. 1, 2, and 2a, contact one another such that the frictional forces, derived from the contact of the contiguous surfaces of the several courses of stacked facing wall units or blocks resist displacement so that the integrity of the resulting gravity facing wall installation is preserved.

Where the facing wall units or blocks of a gravity facing wall would be relatively short in length or where the tolerances between the projections or tongues and grooves would allow for the gravity facing wall blocks to form a curve, as illustrated in FIG. 7 of the drawings, the soil reinforcing sheets or strips of mesh or grids 60 tied or connected to adjacent facing wall units or blocks 12 along the same course can be arranged so that ends 72 of respective mesh or grids 60 overlap as at 94 whereby the localized loads are distributed therebetween and transferred in different directions within the embankment itself.

This can particularly be appreciated wherein the curved gravity facing wall is to contain an embankment that features an object such as tree 96 which is difficult to move, or might not want to be removed, do to landscaping requirements.

End 98 of soil reinforcing grid 100 would be severed in the region of tree 96 and the localized load carried by grid 100 transferred by overlap 94 to end 102 of grid 104 and distributed in a direction indicated by arrow 106 within the embankment.

FIG. 8 illustrates a corner of a gravity facing wall again illustrating the overlap, as at 108, of respective sheets or strips of mesh or grids 60 tied or connected to facing wall units or blocks along the same course to distribute localized loads therebetween and transfer same in different directions within the embankment.

It is also apparent that various combination of mesh or grids 60 where, for example, in the lower courses of the retaining wall system the depth of the backfill behind the facing wall may be limited, requiring that soil reinforcing grids of a high tension modulus be introduced at those levels, and other soil reinforcing grids requiring less tensile reinforcement can be introduced at other levels but in longer strips where the installation permits.

It is therefore to be observed that with the introduction of the improved stackable interlocking facing wall panels or blocks presenting a novel grid-engaging or grid-registering formation to which ends of both uniaxial or biaxial soil reinforcing mesh or grids are tied and substantially confined within the gravity facing wall structure and held therein against separation, that such an installation is more securely anchored against dislodgement and the life of the installation extended.

Moreover, it is obvious that through the use of flexible soil reinforcing mesh or grid where the lengths of the sheets or strips of such mesh or grid can be selected on site by severing same from the rolls of material, that a much greater latitude in structuring and designing a stable gravity retaining wall system has been provided.

Whereas the preferred embodiment of the improved stackable interlocking facing wall panels or blocks have been described and illustrated and their combination with soil reinforcing mesh or grids to establish sound and enduring installation illustrated, persons skilled in the art may adopt other alternatives embodying the invention without departing from the spirit or scope of the invention as defined in the appended claims.

The embodiments of the invention in which an exclusive property or privileges is claimed are defined as follows:

1. In an interlocking facing block for a gravity retaining wall derived from like facing blocks to be stacked in interlocked and overlapped relation in horizontal courses and wherein such gravity retaining wall is adapted to be anchored against dislodgement by securing one or more appropriate suitably tensioned lengths of a selected soil reinforcing grid thereto to extend rearwardly therefrom into the embankment to be contained thereby, said facing block having a body portion with an axis terminating in opposed end surfaces and bounded by front and rear facings and by generally parallel upper and lower surfaces, said body portion including first recess means extending axially thereof and opening to one of said upper and lower surfaces and presenting projection means extending axially thereof and upstanding from the other of said upper and lower surfaces, said first recess means and said projection means having an overall configuration and extent so as to establish an interlock therebetween in axial sliding fit when respective upper and lower surfaces of like facing blocks are disposed in contiguous relation for stacking in overlapped relation in horizontal courses, said projection means including means for interengaging with a grid edge section of a selected soil reinforcing grid to be presented thereto, and a further recess means included within at least one of said upper and lower surfaces and opening to at least said rear facing thereof, said further recess means having an extent such that when like facing blocks are stacked in interlocked and overlapped relation with respective upper and lower surfaces thereof in contiguous relation an interengaged grid edge section is accommodated therewithin.

2. A block according to claim 1 wherein said further recess means has an extent within the respective upper and lower surfaces of the block so as to surround said interengaging means whereby a grid edge section can be fully registered thereover.

3. A block according to claim 2 wherein said further recess means is included in only one of said respective upper and lower surfaces.

4. A block according to claim 1 in which said further recess means opens to said side facings as well as to said rear facing.

5. A block according to claim 1 wherein said axially extending first recess means and said projection means are spaced uniformly inwardly from said front facing thereof a selected unequal extent so as to establish a selected offsetness between successive courses of blocks when like facing blocks are stacked in horizontal courses in interlocked and overlapped relation.

6. A block according to claims 1, 2, 3, 4, or 5 wherein said projection means including said interengaging means is integral with said body portion of said block.

7. A block according to claims 1, 2, 3, 4 or 5 wherein said interengaging means includes a post-like formation so contoured as to penetrate a segment of a selected grid edge section thereof when presented thereto and to protrude thereabove when such segment is disposed in full registration thereover.

8. A block according to claims 1, 2, 3, 4, or 5 wherein said interengaging means includes a post-like formation so contoured as to penetrate and align a segment of a selected grid edge section of a selected grid length to extend rearwardly at substantially right angles to the axial direction of the block when presented thereto and to protrude thereabove when such segment is disposed in full registration thereover and tensioned.

9. A block according to claims 1, 2, 3, 4 or 5 wherein said interengaging means includes at least a pair of axially aligned spaced-apart post-like formations each so contoured as to penetrate and align a segment of a selected grid edge section of a selected grid length presented thereto when such segment is fully registered thereover and tensioned.

10. A block according to claim 1 wherein said interengaging means is releasably separable from said body portion of said facing block.

11. A block according to claim 10 wherein said interengaging means includes at least a pair of aligned spaced-apart upstanding dowels mounted within respective aligned spaced-apart bores presented by one of said upper and lower surfaces of said body portion, each said dowel having a configuration and extent so as to penetrate and protrude above a segment of a selected grid edge section of a length of a selected grid when presented thereto and received in full registration thereover.

12. In an embankment reinforcing structure that includes a gravity retaining wall and at least one or more tensioned lengths of soil reinforcing grid secured thereto and extending rearwardly therefrom within the compacted soil container thereby to reinforce same as well as to anchor said retaining wall against dislodgment wherein said retaining wall includes a plurality of like facing blocks stacked in interlocked and overlapped relation in horizontal courses and in which certain blocks have a body portion with an axis terminating in opposed end surfaces and bounded by front and rear facings and by generally parallel upper and lower surfaces with said body portion including first recess means extending axially thereof and opening to one of said upper and lower surfaces and presenting projection means extending axially thereof and upstanding from the other of said upper and lower surfaces, said first recess means and said projection means having an overall configuration and extent establishing an interlock therebetween in axial sliding fit and overlapped with respective upper and lower surfaces of said blocks in contiguous relation, said projection means including means interengaging with the grid edge section of said length of said selected soil reinforcing grid and secured thereto against separation by the respective adjacent course of blocks and a further recess means included within at least one of said upper and lower surfaces of said block body and opening to at least said rear facing thereof, and of an extent such that with respective upper and lower surfaces thereof disposed in contiguous relation said interengaged grid edge section of said length of said reinforcing grid is accommodated therewithin.

13. An embankment reinforcing structure according to claim 12 wherein said further recess means has an extent within one of the respective upper and lower surfaces of said block so as to surround said upstanding interengaging means whereby a grid edge section can be fully registered thereover.

14. An embankment reinforcing structure according to claim 13 wherein said further recess means is included in only one of said respective upper and lower surfaces of contiguous blocks.

15. An embankment reinforcing structure according to claim 12 in which said further recess means opens to respective said side facings of contiguous blocks as well as to said rear facing.

16. An embankment reinforcing structure according to claim 12 wherein said axially extending first recess means and said projection means are spaced uniformly inwardly from said front facing thereof a selected unequal extent so as to establish a selected offsetness between successive courses of blocks.

17. An embankment reinforcing structure according to claim 12 wherein said axially extending first recess means and said projection means are spaced uniformly inwardly from said front facing thereof a selected unequal extent so as to establish a selected vertically extending disposition between successive courses of blocks.

18. An embankment reinforcing structure according to claims 12, 13, 14, 15, 16 or 17 wherein said projection means including said interengaging means is integral with said body portion of said block.

19. An embankment reinforcing structure according to claims 12, 13, 14, 15, 16 or 17 wherein said interengaging means includes a post-like formation so contoured as to penetrate a segment of a selected grid edge section thereof when presented thereto and to protrude thereabove when such segment is disposed in full registration thereover.

20. An embankment reinforcing structure according to claims 12, 13, 14, 15, 16 or 17 wherein said interengaging means includes a post-like formation so contoured as to penetrate and align a segment of a selected grid edge section of a selected grid length of extend rearwardly at substantially right angles to the axial direction of the blocks when presented thereto and to protrude thereabove when such segment is disposed in full registration thereover and tensioned.

21. An embankment reinforcing structure according to claims 12, 13, 14, 15, 16 or 17 wherein said interengaging means includes at least a pair of axially aligned spaced-apart post-like formations each so contoured as to penetrate and align a segment of a selected grid edge section of a selected grid length presented thereto when such segment is fully registered thereover.

22. An embankment reinforcing structure according to claim 12 wherein said interengaging means is releasably separable from said body portion of said facing block.

23. An embankment reinforcing structure according to claim 22 wherein said interengaging means includes at least a pair of aligned spaced-apart upstanding dowels mounted within respective aligned spaced-apart bores presented by one of said upper and lower surfaces of said body portion, each said dowel having a configuration and extent so as to penetrate and protrude above a segment of a selected grid edge section of a length of a selected grid when presented thereto and received in full registration thereover.

24. A method for constructing an embankment reinforcing gravity facing wall derived from like facing blocks interlocked and overlapped in sliding fit and tied to and anchored by a soil reinforcing grid extending rearwardly therefrom into the embankment so contained, which method comprises the steps of:

a) excavating the soil to a selected depth and providing a generally horizontally extending base suitable to support the gravity facing wall;

b) laying upon the base one or more courses of like interlocking facing wall blocks used in constructing the gravity facing wall at least some of which present upstanding grid interengaging formations and associated recess formations for the reception of a grid edge section of a selected length of reinforcing grid to be secured thereto;

c) securing to a selected upstanding grid interengaging formation presented by certain of the blocks an edge section of a selected length of soil reinforcing grid in one or more regions of the course where the soil reinforcing grid is to extend into the embankment;

d) laying a superior course of like interlocking facing wall blocks in contiguous relation upon the facing wall blocks of the lower course with the blocks in the superior course arranged so that they overlap the blocks in the inferior course and in interlocking sliding fit therewith and confine the respective secured edge section within the aforementioned associated recess formations;

e) laying out the respective length of soil reinforcing grid so secured to extend rearwardly therefrom and upon backfill delivered to that region and compacting same; and f) repeating the aforementioned steps in sequence so as to establish an anchored gravity facing wall structure up to a selected height and to thereby reinforce the compacted soil embankment contained thereby.

* * * * *